US005903927A

United States Patent [19]

Wolfe et al.

[11] Patent Number: 5,903,927

[45] Date of Patent: May 18, 1999

[54] CAP WITH SOUND GENERATING NOVELTY ATTACHMENT

[76] Inventors: Charles Herbert Wolfe; Susan Gale Wolfe, both of 23045 Alabaster Ave., Port Charlotte, Fla. 33952; Michael David Cooke, 121 E. Okeechobee Rd., Hialeah, Fla. 33010

[21] Appl. No.: 09/167,644

[22] Filed: Oct. 6, 1998

Related U.S. Application Data

[60] Provisional application No. 60/061,561, Oct. 7, 1998.

[51] Int. Cl.[6] ..... A42B 1/24

[52] U.S. Cl. ..... 2/209.13; 2/244; 2/906; 446/27

[58] Field of Search ..... 2/195.1, 209.13, 2/244, 906; 446/27

[56] References Cited

U.S. PATENT DOCUMENTS

| | | | |
|---|---|---|---|
| 4,991,235 | 2/1991 | Warner | 446/27 |
| 5,462,471 | 10/1995 | Power-Fardy | 2/209.13 |
| 5,768,714 | 6/1998 | Bowhey | 2/209.13 |

*Primary Examiner*—Diana L. Biefeld
*Attorney, Agent, or Firm*—Frank A. Lukasik

[57] ABSTRACT

The invention is directed to a combination of a baseball cap, a sound generator and a three dimensional image of an object having a distinctive sound. A lower case is fastened to the baseball hat with snap fasteners and an upper case is formed in the shape of the image being recorded and played by the sound generator. The application discusses examples of attachments to the cap consisting of an auto scoop, a three barrel carburetor, a boat and a helicopter.

6 Claims, 7 Drawing Sheets

CAP WITH SOUND GENERATING NOVELTY ATTACHMENT

This is a continuation of provisional application Ser. No. 60/061,561, filed Oct. 7, 1998.

BACKGROUND OF THE INVENTION

FIELD OF THE INVENTION

The invention relates to novelty apparel, and more specifically, the invention relates to a combination of a baseball style cap with bill, a sound generator, with a three dimensional image of a related object creating the sound attached to the top of the cap.

SUMMARY OF THE INVENTION

The invention consists of a tight fitting cap with a bill, with a three dimensional image of an object fastened as an attachment on top of the cap with a related sound generator mounted within the cap or in the attachment. The attachments may be images (models) of any type of mechanical device, such as, for example, an auto hood scoop and/or blower and/or two or three barrel carburetors, boats, helicopters, aircraft etc. An electronic circuit board with a speaker, battery operated, contains a pre-recorded sound simulating the sound generated by the operation of the object of the attachment.

DETAILED DESCRIPTION OF THE PREFERRED EMBODIMENTS

Figure 1:
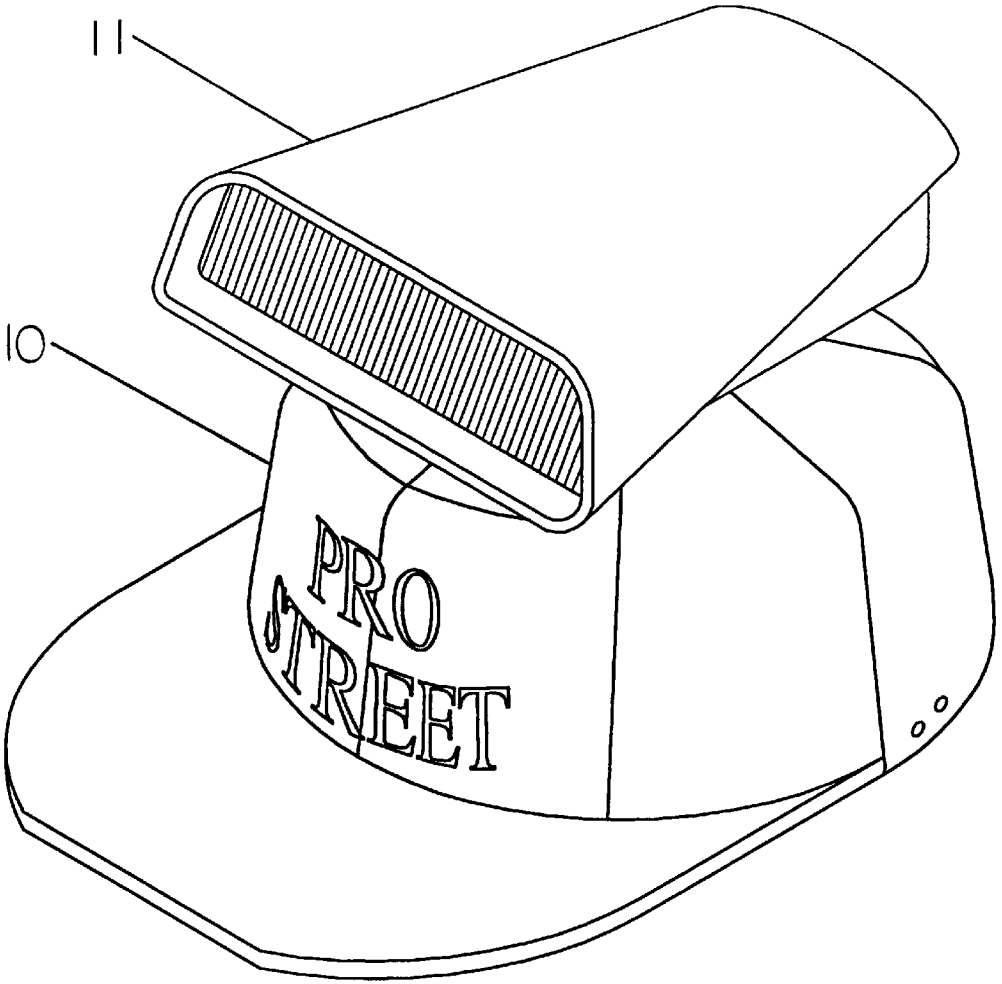
FIG. 1. is a top perspective view of a baseball hat with a three dimensional image of an auto hood scoop as an attachment in accordance with the invention.
Figure 2:
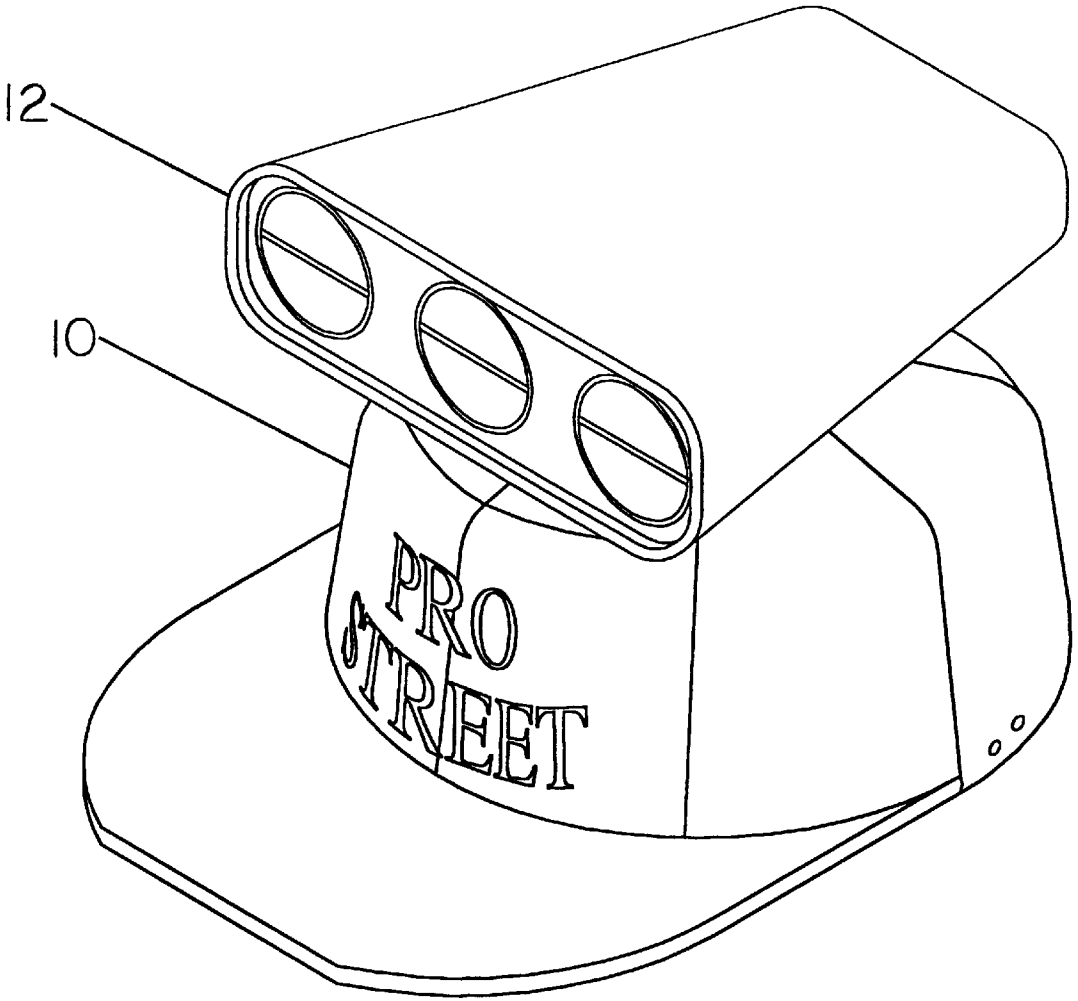
FIG. 2. is a top perspective view of a baseball hat with a three dimensional image of a three barrel carburetor as an attachment in accordance with the invention.
Figure 3:
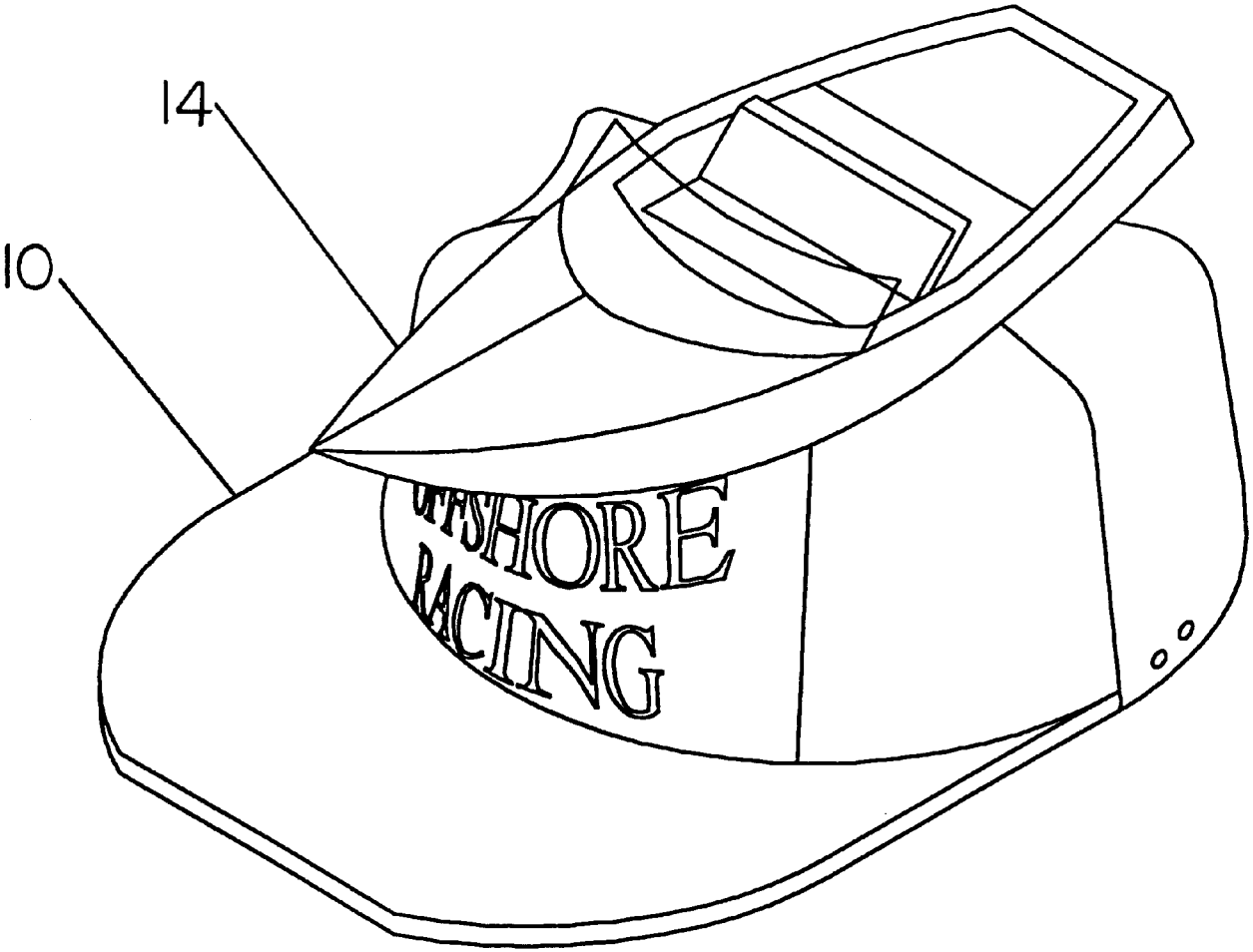
FIG. 3. is a top perspective view of a baseball hat with a three dimensional image of a boat as an attachment in accordance with an invention.
Figure 4:
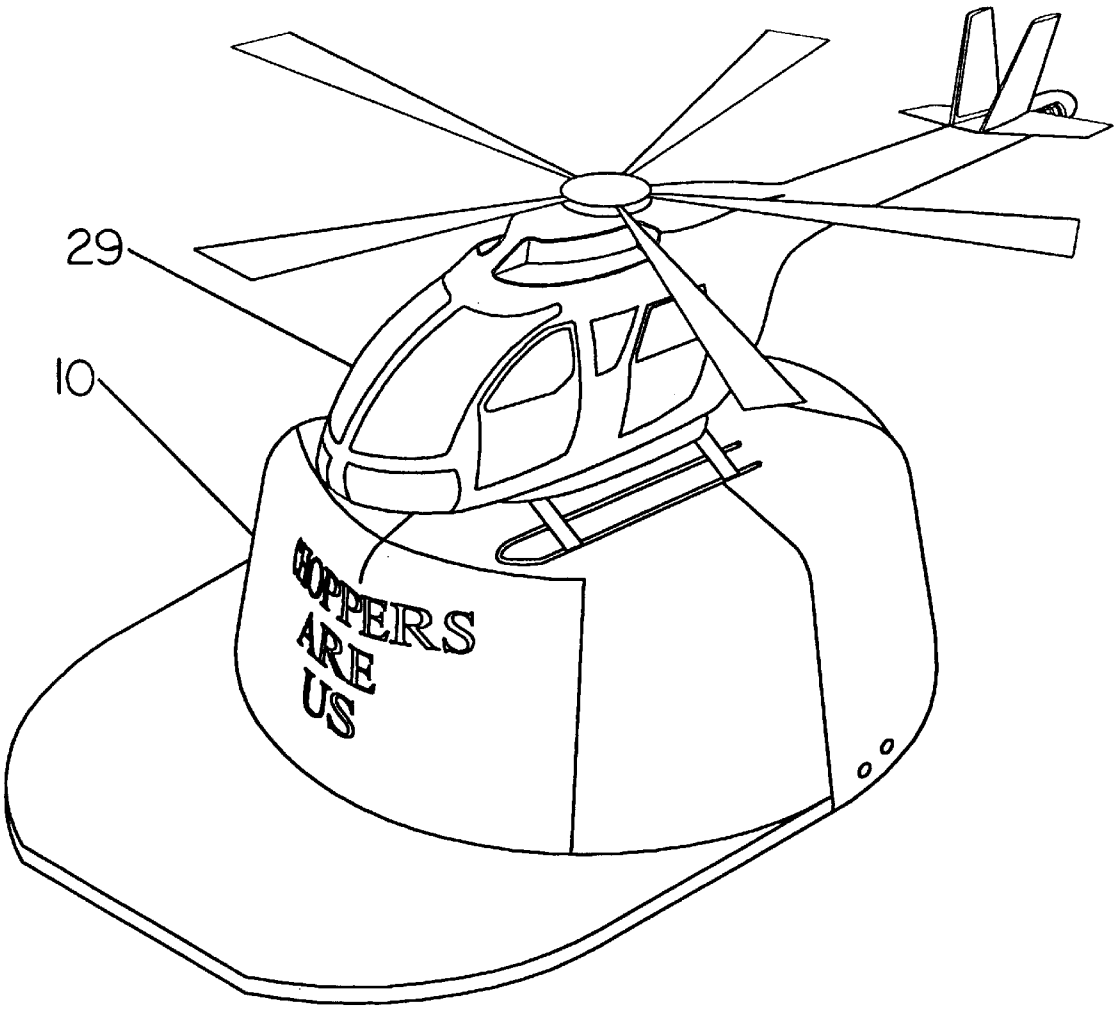
FIG. 4. is is a top perspective view of a baseball hat with a three dimensional image of a helicopter as an attachment in accordance with the invention.

Referring now to FIG. 1, there is shown a top perspective view of a baseball hat 10 with the image of an auto hood scoop attachment 11. FIG. 2 is a baseball hat 10 with the image of a three barrel carburetor attachment 12. The auto scoop attachment 11 and the three barrel carburetor attachment 12 may have the sound of an engine pre-recorded in the sound generator 13. FIG. 3 shows a baseball hat 10 with a boat attachment 14. The sound generator 13 may have the sound of a large racing boat engine racing at a very high RPM or revving up to a high speed. FIG. 4 shows another embodiment of the invention as a helicopter attachment 29. The sound generator 13 may be pre-recorded with the unique sound of the rotors of a helicopter in motion.

Figure 5:
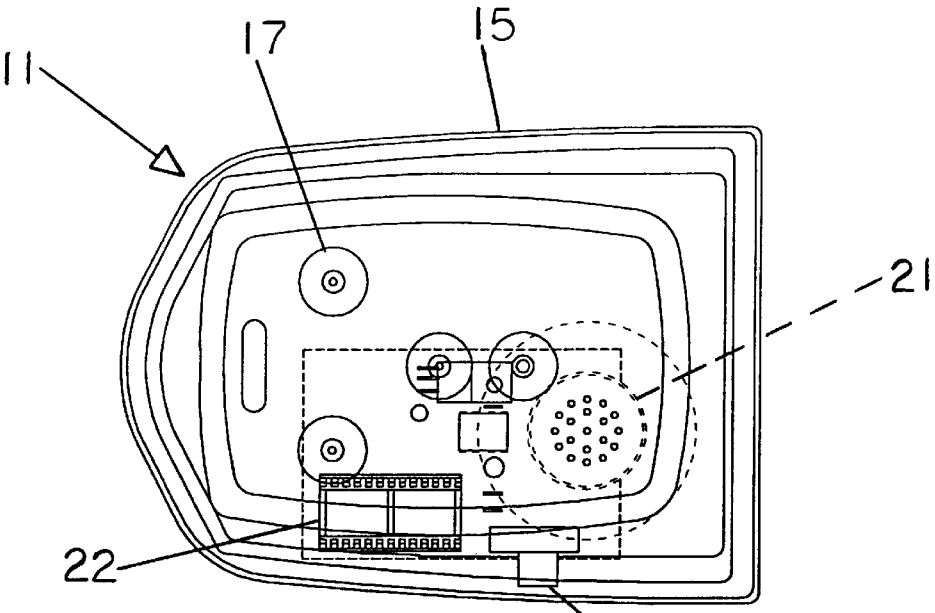
FIG. 5. is a top view of the auto hood scoop attachment showing a sound generator in accordance with the invention.
Figure 6:
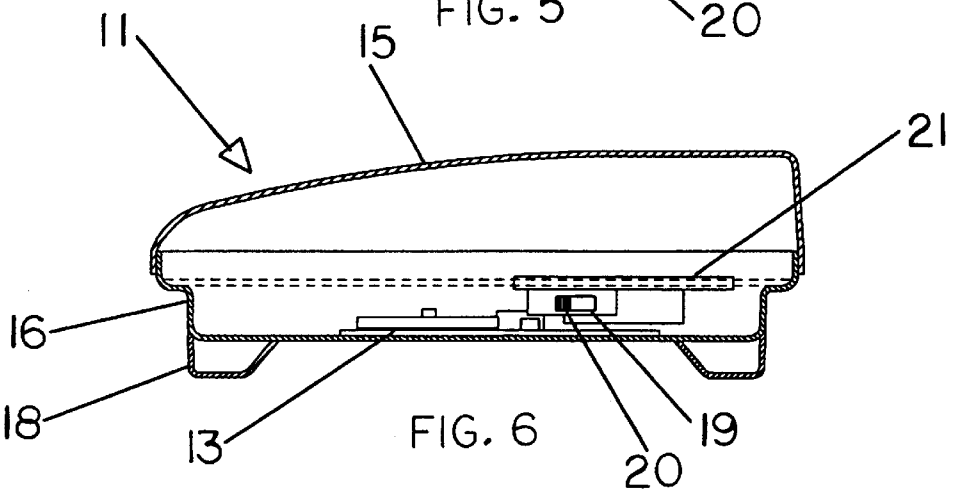
FIG. 6. is a side view, partially in section, of the auto hood scoop attachment showing the sound generator in accordance with the invention.

FIGS. 5 and 6 show details of the shape of the auto scoop attachment 11 which consists of the upper case 15 and the lower case 16. The lower case 16 is fastened to the baseball hat 10 with snap fasteners 17. A mating snap fastener 17 is affixed to the baseball hat 10. The lower case 16 is formed with a base 18 which is shaped to fit the roundness of the top of the baseball hat 10 and the wearer's head. The upper case 15 is also formed in shapes of attachments 12, 29, and 14. The two sections, upper case 15 and lower case 16 are snapped together and held together by a force fit. A slot 19 is formed in the lower case 16 to accommodate the On-Off switch 20 of sound generator 13. Speaker 21 of sound generator 13 is shown in dotted lines. Also shown in FIG. 5 is the circuit board 22 of sound generator 13.

Figure 7:
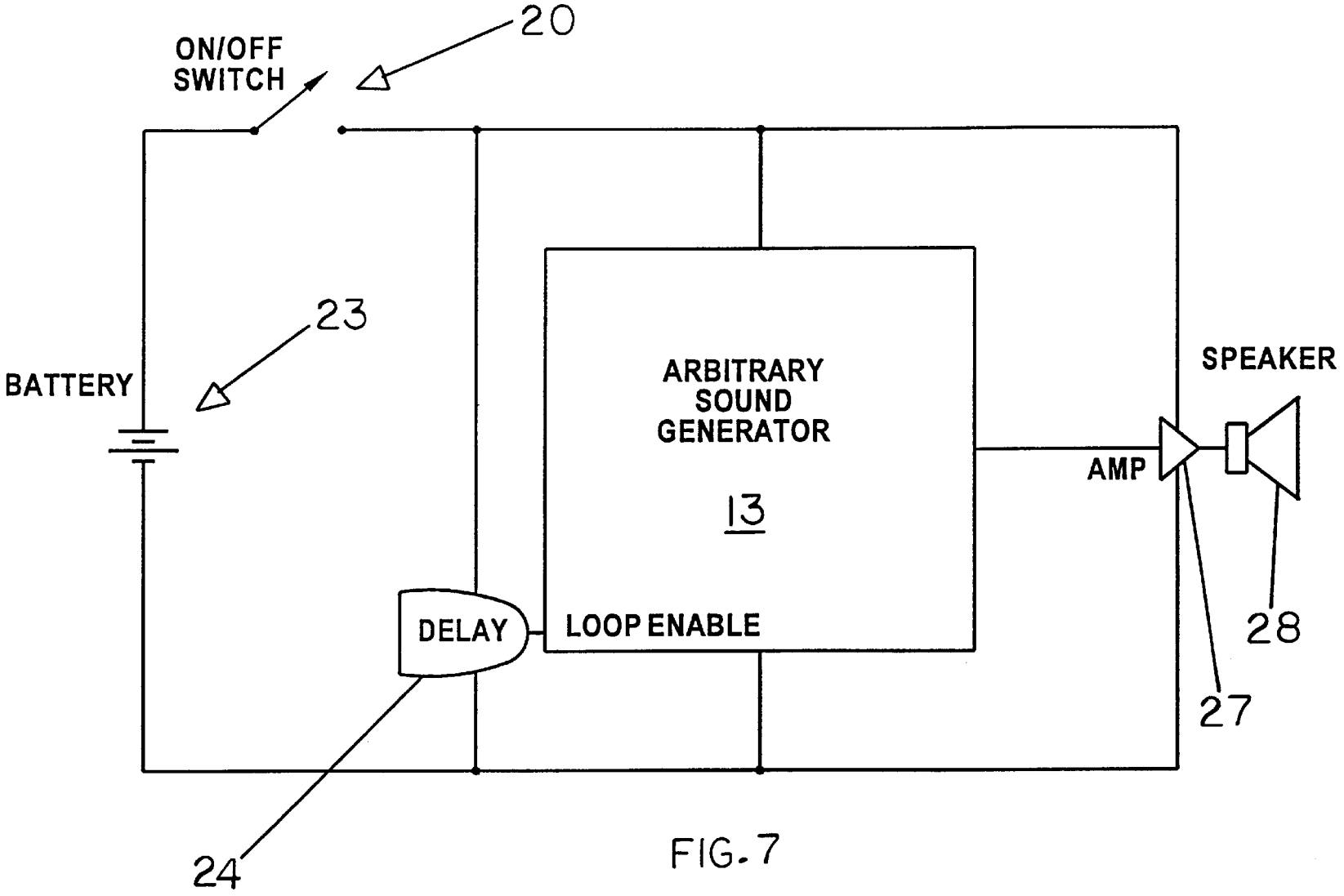
FIG. 7. is a block diagram of the sound generator in accordance with the invention.
Figure 8:
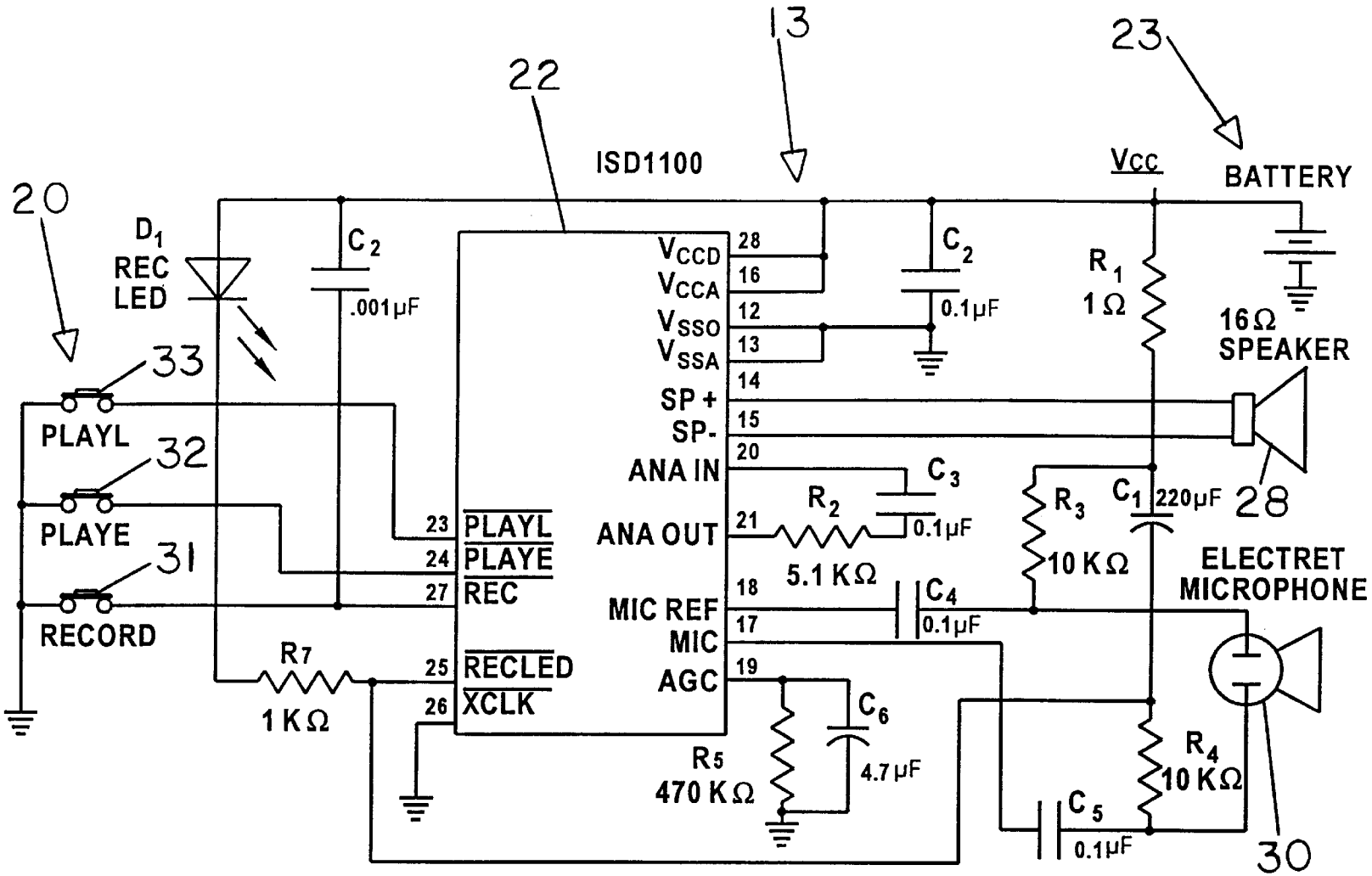
FIG. 8. is a schematic view of the sound generator in accordance with the invention.

FIG. 7 is a block diagram of the sound generator 13 and consists of the battery 23, On-Off switch 20, delay circuit 24, Loop enable circuit 25, arbitrary sound generator 13, amplifier 27 and speaker 28. FIG. 8 shows the schematic diagram of sound generator 13 which includes a power supply, battery 23, speaker 28, microphone 30, and circuit board 22. Switch 20 may also have a record position 31 and two play positions 32, and 33. In operation, the related sound of the attachments 11, 12, 29, or 14 is pre-recorded in the sound generator 13 prior to assembly of the hat 10 and the attachments. The wearer may then at appropriate times activate the sound generator 13 with switch 20 when desired.

Thus it will be appreciated that the present invention provides a novelty apparel consisting of an image of any mechanical device having a distinctive sound pre-recorded and can be mounted on any style baseball cap currently on the market. It is contemplated that other embodiments and/or modifications may be made in the present invention without departure from inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. The combination of a novelty apparel, a sound generator and a three dimensional image of an object having a distinctive sound, said combination consisting of:

a tight fitting cap with a bill, a lower case fastened to said cap with snap fasteners, said lower case having a base shaped to fit the contours of said cap, means for recording and playing back a sound simulating the sound made by said object, said means being fastened within said lower case, and an upper case mounted on said lower case and enclosing said lower case, said upper case having said three dimensional image of said object formed thereon, said image having a shape related to and representing said sound source.

2. The combination of claim 1 wherein said means for recording and playing back said sound, consists of a power supply, a switch, an arbitrary sound generator, a microphone, a speaker, and an amplifier.

3. The combination of claim 1 wherein said object is an auto scoop.

4. The combination of claim 1 wherein said object is a three barrel carburetor.

5. The combination of claim 1 wherein said object is a helicopter.

6. The combination of claim 1 wherein said object is a boat.

* * * * *